US006935891B2

(12) United States Patent
Kiely

(10) Patent No.: US 6,935,891 B2
(45) **Date of Patent: *Aug. 30, 2005**

(54) SNAP FITTING ELECTRICAL CONNECTOR

(75) Inventor: Kenneth M. Kiely, Milford, CT (US)

(73) Assignee: Bridgeport Fittings, Inc., Stratford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/790,283

(22) Filed: Mar. 1, 2004

(65) Prior Publication Data

US 2004/0166708 A1 Aug. 26, 2004

Related U.S. Application Data

(63) Continuation-in-part of application No. 10/283,978, filed on Oct. 30, 2002, now Pat. No. 6,860,758.

(51) Int. Cl.[7] ..... H01R 13/73
(52) U.S. Cl. ..... 439/557; 439/535
(58) Field of Search ..... 439/553, 557, 439/535, 543, 567, 552; 174/65 R; 200/295–7

(56) References Cited

U.S. PATENT DOCUMENTS

| | | | | |
|---|---|---|---|---|
| 1,483,218 A | | 2/1924 | Fahnestock | 439/557 |
| 1,725,883 A | | 8/1929 | Recker | |
| 1,830,250 A | | 11/1931 | Tiefenbacher | |
| 2,156,003 A | | 4/1939 | Tinnerman | 174/153 R |
| 2,445,663 A | | 7/1948 | Peters | |
| 2,823,932 A | | 2/1958 | Schigut | |
| 3,183,297 A | | 5/1965 | Curtiss | 174/65 R |
| 3,436,105 A | | 4/1969 | Miklya | |
| 3,544,705 A | | 12/1970 | Winston | |
| 3,631,738 A | | 1/1972 | Harper | |
| 3,788,582 A | | 1/1974 | Swanquist | |
| 3,814,467 A | | 6/1974 | Van Buren, Jr. | |
| 3,858,151 A | | 12/1974 | Paskert | |
| 3,993,333 A | | 11/1976 | Biswas | |
| 4,012,578 A | | 3/1977 | Moran et al. | |
| 4,021,604 A | | 5/1977 | Dola et al. | |
| 4,032,178 A | | 6/1977 | Neuroth | |
| 4,159,405 A | * | 6/1979 | Semonchik et al. | 200/296 |
| 4,361,302 A | | 11/1982 | Lass | |
| 4,468,535 A | | 8/1984 | Law | |
| 4,496,791 A | * | 1/1985 | Reichert et al. | 200/296 |
| 4,619,332 A | | 10/1986 | Sheehan | |
| 4,621,166 A | | 11/1986 | Neuroth | |
| 4,626,620 A | | 12/1986 | Plyler | |
| 4,657,212 A | | 4/1987 | Gilmore et al. | |
| 4,711,472 A | | 12/1987 | Schnell | |
| 4,773,280 A | | 9/1988 | Baumgarten | |
| 4,880,387 A | | 11/1989 | Stikeleather et al. | 174/65 R |
| 4,981,310 A | | 1/1991 | Belisaire | |
| 4,990,721 A | | 2/1991 | Sheehan | |
| 5,132,493 A | | 7/1992 | Sheehan | |
| 5,171,164 A | | 12/1992 | O'Neil et al. | |
| 5,189,258 A | | 2/1993 | Pratesi | |
| 5,266,050 A | * | 11/1993 | O'Neil et al. | 439/552 |
| 5,342,994 A | | 8/1994 | Pratesi | 174/65 R |
| 6,780,029 B1 | * | 8/2004 | Gretz | 439/557 |

* cited by examiner

*Primary Examiner*—Renee Luebke
(74) *Attorney, Agent, or Firm*—Fattibene & Fattibene; Arthur T. Fattibene; Paul A. Fattibene

(57) ABSTRACT

An electrical connector having an inlet end and an outlet end wherein the leading or outlet end is provided with a pair of spaced apart shoulders defining therebetween an annular recess and a snap fit retainer ring fitted onto the outlet end, the retainer ring having at least two series of spring tangs blanked out of the plane thereof, and which tangs are formed to effect a positive grounding connection with an associated electric box in the event any slight deviations are encountered within the parameters of the adopted standards, and whereby the annular recess functions to provide a relief for the spring tangs to facilitate and minimize the required insertion force and to insure a positive ground connection between the connector and the electrical box in the assembled position. In another form of the invention, the snap fit retaining ring is provided with longitudinally and/or laterally spaced depressions transversely the width of the snap fit retaining ring for use on a connector formed with a threaded end.

4 Claims, 4 Drawing Sheets

SNAP FITTING ELECTRICAL CONNECTOR

RELATED APPLICATION

This application is a continuation in part application of a application Ser. No. 10/283,978 filed Oct. 30, 2002 for Snap Fitting Electrical Connector, now U.S. Pat. No. 6,860,758 B1.

FIELD OF THE INVENTION

This invention relates to an electrical connector for connecting an electrical conductor to an electrical box, and more specifically to an electrical connector that can be readily connected to an electrical box with a snap fit.

BACKGROUND OF THE INVENTION

Connectors for attaching an electrical conductor to an electrical box or junction box and the like are well known in the art. Such electric boxes, junction boxes, fuse boxes and the like are uniformly used in virtually all residential and commercial buildings, and buildings in general. As a result, such electrical boxes have been standardized. However, even though such electrical boxes have been generally standardized, it has been noted that while such boxes may conform to the standards adopted, there still exists some slight variations and deviations that occur within the accepted limited of the established standard. For example, the punch or knock out opening formed in such electrical boxes may vary slightly in size by small amounts. Such size variations can cause a connector used in such instance to be improperly or not properly grounded.

It has also been observed that many of the commonly known connectors are limited for use with only a specific type of electrical conductor, e.g. applicable for use only with helically wound armor or BX type cable or for use with non-metallic sheathed cables, or co-axial cables and the like. Such known connectors are evidenced in U.S. Pat. Nos. 1,725,883; 1,830,250, and 2,823,932 for metallic armor or BX cables; U.S. Pat. Nos. 2,445,633; 4,711,472 and 5,132,493 for non-metallic conductors; and U.S. Pat. Nos. 3,544,705; 3,631,738 and 3,788,582 for co-axial type cables.

Other connectors are known, as for example, as evidenced by U.S. Pat. Nos. 5,171,164 and 5,266,050. While the connectors disclosed in said latter patents are provided with a spring steel adaptor to effect the securing of the connector to an electrical box, some difficulty and excessive force may be required to effect the connection, as the connector does not provide any relief space to accommodate the deflection of the spring tangs or fingers during insertion through the knock out opening of an electrical box. It has been further observed that proper grounding may not be achieved in the event a given electrical box has a knock out opening which may be slightly oversized or the connector is slightly undersized, but still within the parameters of the adopted standards for electrical box and associated connectors.

Other connectors having a retaining clip for use with connectors for an electrical box are evidenced by U.S. Pat. Nos. 5,189,258 and 5,342,994. These patents relate to a novel retaining clip for use with connectors having a thread engaging portion that permits the securing of a threaded connector to an electrical box without threading the connector to the electrical box.

The connectors are generally a metal casting having a connector body or sleeve with a conductor or wire inlet end and a conductor outlet end, the outlet end being adapted to be received within a "knock out" opening formed in the electric box. Generally, the outlet end of the connector body is provided with external threads so that when fitted into the "knock out" opening, the connector is secured to the electric box by a nut threaded onto the threaded outlet end of the connector body.

In assembling such a connector to the electric box, one is required to use two hands, one for holding the connector in place while the other hand is used for threading the nut about the threaded outlet end of the connector, which is often rendered tedious, difficult and time consuming. This is because the nut is required to be threaded onto the connector within the confines of the electric box where space and visibility is very restricted.

Accordingly, the instant invention is directed to further improvements relating to means for more effectively securing or connecting an electrical connector to an electrical box in a manner to insure a positive grounding despite any slight deviations of size that may occur within the adopted standards for such electrical boxes and associated connectors.

SUMMARY OF THE INVENTION

An object of this invention is to provide an electrical connector having a novel retaining means for effecting a snap fit connection with an associated electrical box that requires a minimum of force and a maximum of ease.

Another object is to provide an electrical connector having an improved retaining ring that will insure a more positive grounding effect despite slight variations that may occur either in the construction of the electric box and/or the connector body.

Another object is to provide an electrical connector capable of use with metallic armored cables, non-metallic sheathed conductors or cable and/or co-axial cables and the like.

Another object is to provide an electrical connector that is relatively simple in construction, positive in operation and economical to fabricate.

An object of this invention is to provide for a simpler and more expedient way of securing a threaded connector to an electric box.

Another object of the invention is to provide a snap fit retaining ring for securing a threaded connector to an electric box.

Another object is to provide a snap fit retaining ring having staggered depressions or dimples for engaging the grooves of the threaded outlet end of the connector to prohibit any inadvertent separation of the connector from the electric box.

Another object is to provide a snap fit retaining ring which is particularly adapted to be used on a connector having interrupted threads whereby the opposed portion of the outlet end of the connector are free of threads.

Another object is to provide a connector assembly having a threaded connector body and a readily removable snap fit retaining ring whereby the connector assembly may, at the option of the user, be connected to an electric box by a snap fit connection or by a threaded connection to an electric box with a threaded female hub.

The foregoing objects and other features and advantages are attained by an electrical connector having a connector body provided with an inlet end having an inlet opening sized to receive armored cable, BX type conductors, non-metallic sheathed conductors or co-axial cables and the like, and an outlet end defining the outlet opening. The connector body is provided with a radial outwardly extending flange intermediate the inlet and outlet ends thereof, which functions as a stop to limit the insertion of the connector through the knock out opening of an electrical box.

The outlet end of the connector is provided with a pair of spaced apart shoulders which define therebetween an annular recess or space which circumscribes the outlet end. A radial outwardly extending end flange circumscribes the outermost shoulder. A snap fit retaining ring formed of suitable spring steel is loosely mounted on the spaced apart shoulders wherein the opposed peripheral edges of the retaining ring are confined between the intermediate flange and the end flange circumscribing the outlet end or opening of the connector. The retaining or snap fit ring is provided with two series of circumferentially spaced tangs that are blanked, lanced or cut out of the retainer or snap fit ring material, which are arranged in the assembled position to securely lock the connector in place to an electrical box, and at the same time insure a positive electric grounding of the connector to the electric box, despite any slight deviation in the size of the knock out opening or outlet end of the connector.

The inlet end of the connector body is provided with an inlet opening for receiving the outer armored or non-metallic covering of a conductor cable. The inlet end is further provided with opposed side walls which are interconnected by a top wall. An adjustable clamping member in the form of a C shaped member is supported on the inlet end of the connector to firmly secure the cable to the inlet end of the connector. An adjusting screw secures the clamping member to the inlet portion by which the clamping member can be adjusted as required.

Certain of the foregoing objects, features and other advantages are attained by a threaded connector having a body with a bore extending therethrough to define an inlet and an outlet end whereby the outlet end has formed thereon external interrupted threads circumferentially disposed approximately, but less than, 180° about the outlet end so that the opposed or opposite portions of the outlet end of the connector are free of threads. Thus, the opposed external portion of the outlet end free of the threads defines a generally flattened surface as a result of the absence of any threads.

Adapted to be disposed about the threaded outlet portion of the connector body is a snap fit retaining ring. The snap fit retaining ring is formed from an elongated blank of spring steel having a width sized to fit about the threaded end of the connector. Formed at spaced intervals longitudinally of the blank are two series of tangs, each series comprising a plurality of tangs that are blanked, lanced or cut out of the material of the blank, as hereinabove described. The respective tangs are bent radially outwardly from the plane surface of the blank. One end of the blank is formed with a tongue while the other end of the blank is formed with a notch adapted to receive the tongue when the blank is formed into a ring. Also formed in the blank are a series of depressions or dimples which are longitudinally spaced along the blank and laterally offset transversely of the width of the blank. The dimples or depressions extend inwardly so as to engage with or be received within the grooves of the threads when the blank is formed into a ring and disposed about the outlet end of the connector body. When the blank is formed to define the retainer ring, the locking tangs are cantileverly bent radially outwardly of the surface of the blank forming ring and the opposed portion of the snap ring being flattened to complement the portions of the outlet end of the connector body free of any threads. When the snap ring is assembled to the connector, the complementary flats of the snap ring and connector outlet end prohibit relative rotation between the retainer ring and the connector body. The radially inwardly depressions or dimples mating with the thread grooves prohibits the connector body from being inadvertently pulled free or separated from the electric box when the connector is fixedly secured to an electric box.

Other features and advantages will become readily apparent in view of the drawings and detail description.

IN THE DRAWINGS

DETAIL DESCRIPTION

Figure 1:
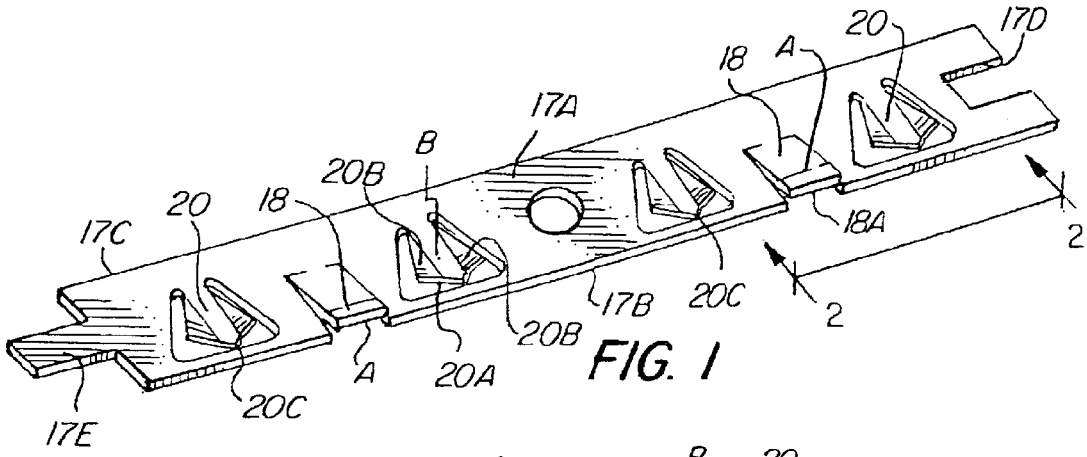
FIG. 1 is a perspective plan view of the blank from which the retaining ring embodying the invention is formed.

Referring to the drawings, there is illustrated an electrical connector 10 that embodies the instant invention. As shown, the electrical connector 10 includes a connector body 11 that has a cable or inlet end 11A and an outlet end 11B. The connector body 11 may be formed as a metal casting of any suitable metallic material such as zinc, aluminum, and/or any suitable metallic alloy. A radially outwardly extending intermediate flange 12 circumscribes the connector body 11 between the inlet end 11A and the outlet end 11B. The outlet end 11B is generally circular and is provided with a pair of spaced apart shoulders 13 and 14 circumscribing the outlet end 11B that define therebetween a space or recess 15. Circumscribing the outermost shoulder 14 is a radially outwardly extending end flange 16.

Figure 2:
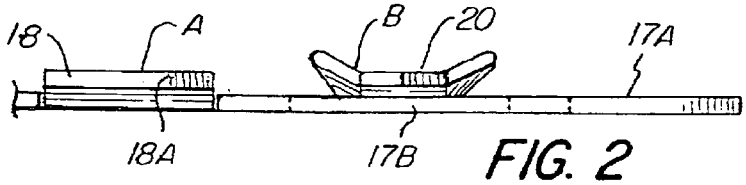
FIG. 2 is a partial end view taken along line 2—2 on FIG. 1.
Figure 4:
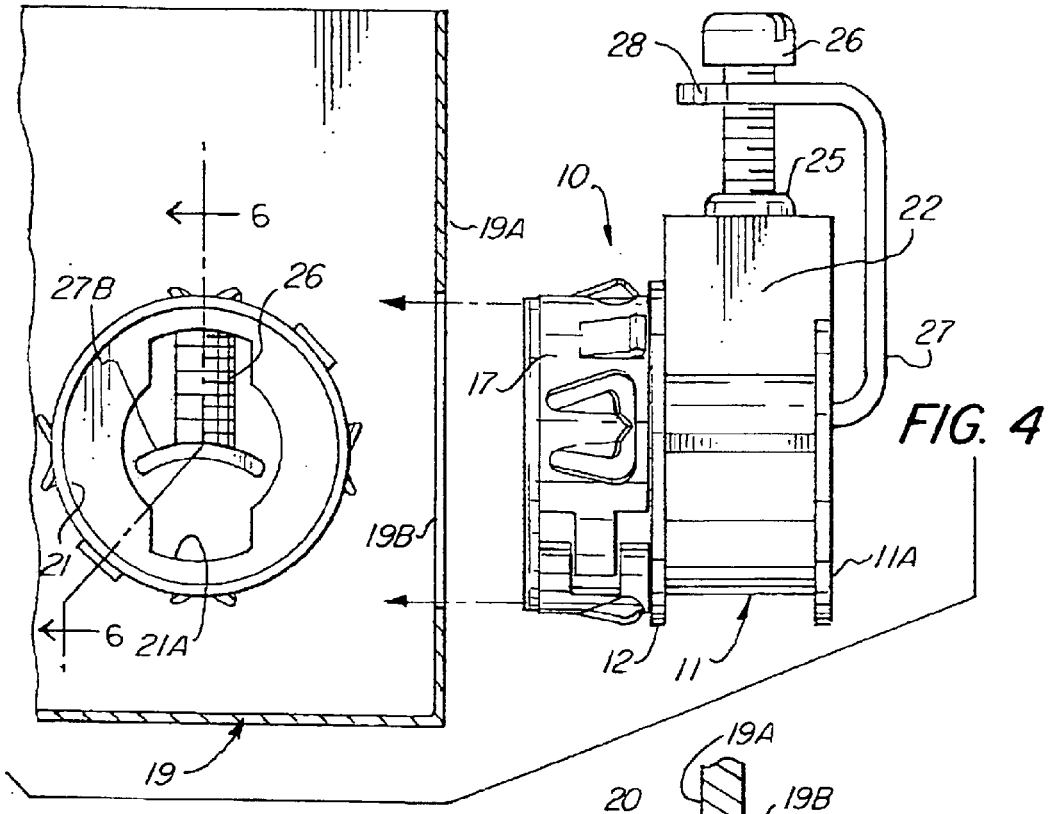
FIG. 4 is an exploded side view to illustrate the manner in which the connector is adapted to be secured to an electrical box, and illustrating another similar connector secured in place to another wall portion of an electrical box.
Figure 5:
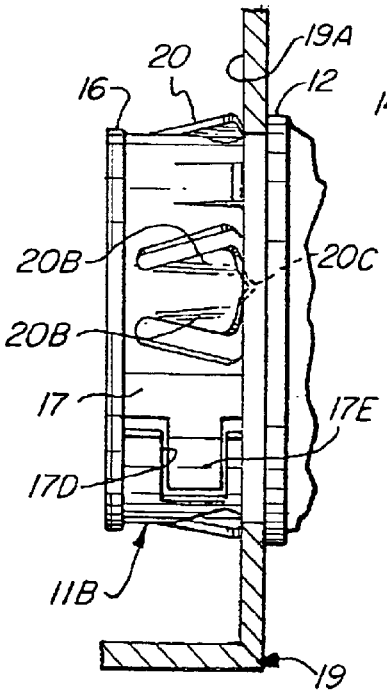
FIG. 5 is a detail side view of the connector embodying the invention connected to an electrical box.
Figure 6:
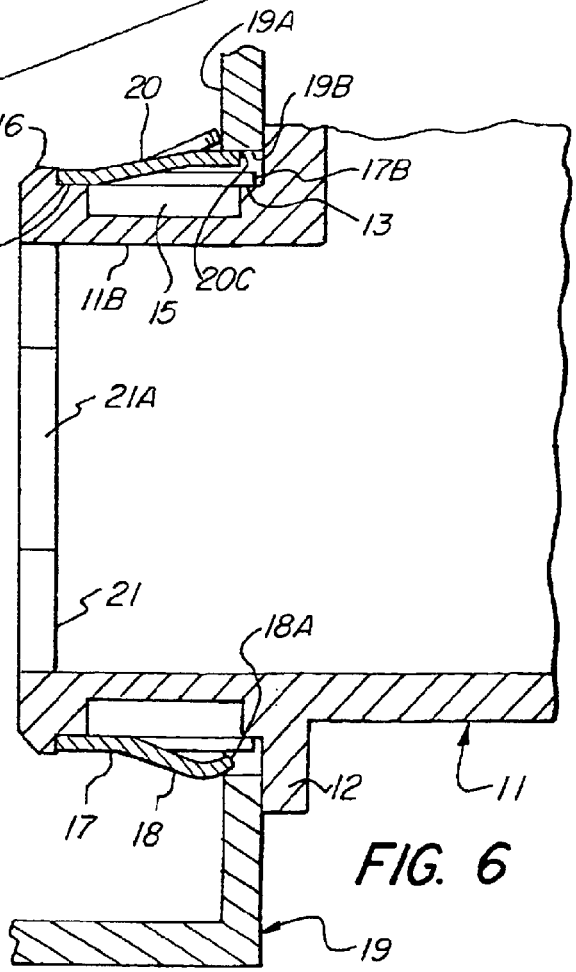
FIG. 6 is a sectional side view taken along line 6—6 on FIG. 4.

In accordance with this invention, a specially constructed retaining or snap fit ring 17 is loosely supported on shoulders 13 and 14, as best viewed in FIG. 6. The retainer or snap fit ring 17 is formed of a suitable spring type steel. Referring to FIGS. 1 and 2, the retainer or snap fit retainer ring 17 is formed from a flat blank 17A of spring steel having a width size sufficient to extend between and ride on or be supported by shoulders 13 and 14 in the assembled position, as best seen in FIGS. 4 to 6. The length of the blank 17A is such that, when formed into the retainer ring 17 as shown in FIG.

3, will define a complete ring having an expandable circumference sufficiently expandable to be fitted over the end flange 16 for positioning the same onto shoulders 13 and 14, as shown in FIG. 6.

Figure 3:
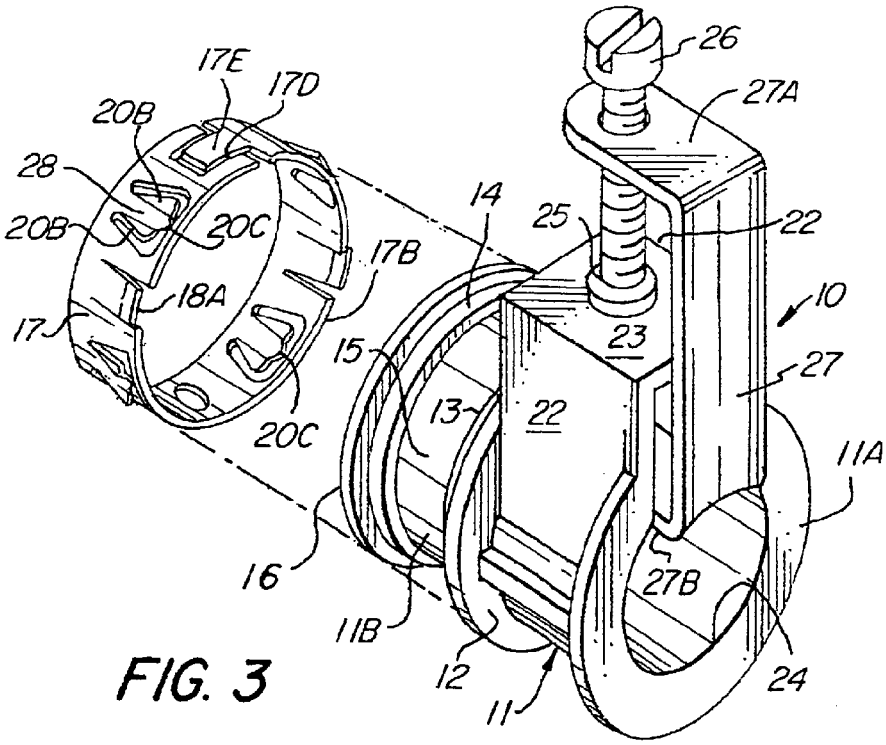
FIG. 3 is an exploded perspective view of an electrical connector embodying the invention.

Referring to FIGS. 1 and 2, the blank 17A of the retaining ring 17 is formed with two series of tangs, e.g. a series of A tangs and a series of B tangs. As shown, the series A and B tangs each include a plurality of similarly constructed tangs arranged to be circumferentially and/or alternately spaced about the circumference of the retainer ring 17 in the assembled state, as shown in FIG. 3.

The tangs or spring fingers 18 forming the series A tangs are lanced, blanked or formed out of the plane or material of blank 17A in a manner whereby the free ends 18A of tangs 18 include a portion of the longitudinal edge 17B of blank 17A that is adapted to be supported on shoulders 13 in the assembled position, as shown in FIG. 6. The tangs 18 forming the series A tangs are bent outwardly of the plane or material of the blank 17A in a cantilever manner. The free ends 18A of the respective tangs 18 forming the series A tangs are then formed or arcuately shaped to define a compound arch or curvilinear cross sectional shape, as best seen in FIG. 6. As will be hereinafter described, the compounded curvilinear or rolled shape of the free ends 18A of tangs 18 in both a transverse and longitudinal direction will effect a positive electrical grounding connection with a metallic electric box 19.

The tangs 20 forming the series B tangs are blanked or die cut out or formed of the plane or material of the blank 17A intermediate of the opposed longitudinal edges 17B and 17C. As best shown in FIG. 1, the free ends 20A of tangs 20 are spaced inwardly from the trailing edge 17B. Also, tangs 20 are bent outwardly of the plane or material of the blank 17A as noted in FIG. 2 and FIG. 6. Tangs 20 are formed with opposed outwardly bent wing portions 20B which are arranged to cam the tangs 20 downwardly into the relief space or recess 15 as the connector 10 is inserted through a knockout opening 19B of an electric box 19. Tangs 20 are also provided with a projecting tit or projection 20C. As best seen in FIG. 6, the free ends of the wing portions 20B of tangs 20 engage the inner surface 19A of the electrical box 19, as seen in FIG. 6, while the projection or tit 20C engages the periphery of the knock out hole 19C to also insure a positive electrical grounding between the connector 10 and the electrical box 19.

The retainer ring blank 17A is formed at one end with a notch 17D and at the other end with a complementary tongue 17E so that when formed into a ring, defines a complete 360° ring 17. As shown in FIGS. 3 and 5, the tongue 17E is received in notch 17D in a manner to prohibit any lateral play between the tongue 17E and groove 17D. As the ring 17 is formed of spring steel or other suitable metallic spring like material, the ring 17 is rendered sufficiently flexible to permit the retainer ring 17 to be assembled and supported onto the opposed shoulders 13 and 14 of the outlet end 11B.

The outlet end 11B is provided with an end wall 21 having an elongated outlet opening 21A, the end wall 21 functioning as a stop for the cable covering or sheath, so that the unsheathed conductors can be extended through opening 21A.

The inlet portion 11A is generally of a shape for receiving various types of cables or conductors, as herein described. The inlet portion 11A is also provided with a means for securing the sheathed conductor or cable within the inlet portion 11A. In the illustrated embodiment, the securing means include a pair of spaced apart end wall extensions 22, 22 interconnected by a web or top wall 23 to define a bridge extending to one side of the inlet opening 24. The web or top wall 23 is provided with a tapped hole 25 for receiving an adjusting screw 26. Operatively associated with the adjusting screw 26 is a C shape clamp 27. As best seen in FIG. 3, the clamp 27 includes spaced apart leg portions 27A, 27B. The leg portion 27A is provided with an opening 28 for receiving the threaded shank of the adjusting screw 26 and the lower leg portion 27B being freely rotatably connected relative to the other end of the adjusting screw 26. The arrangement is such that when the adjusting screw 26 is rotated in one direction or the other, the clamp 27 will be moved into or out of the inlet end to effect the clamping or unclamping of the sheathed conductor (not shown). As best seen in FIG. 4, the lower leg portion 27B may be arcuately shaped to provide for a more positive clamping effect on the cable or conductor.

In operation, with a connector 10 as described, and referring to FIGS. 4 to 6, it will be noted that a workman need only to insert the connector 10 through a knock out hole 19B to effect a positive snap fit connection. On inserting the outlet end 11B through the knockout opening 19B, the tangs 18 and 20 of the series A and B tangs will depress. In doing so, the recess or space 15 will function as a relief to minimize the force necessary to effect the insertion. This is because the tangs 18 and 20 can be depressed into the relief space 15 and not against the surface of the outlet end. As the intermediate flange 12 engages the wall of the electric box, the spring tangs 20 will spring outwardly whereby the free ends of the wing portion 20B, 20B of the tangs 20 engage the inner surface 19 of the electrical box while the projecting tit or projection 20C engages the inner periphery of the knock out hole 19B, as best seen in FIG. 6. Simultaneously, the arcuate shaped free end 18A of tangs 18 of the series A tangs will positively engage the edge of the knock out hole 19B, as best seen in FIG. 6. The arcuate shape of the free end 18A of tangs 18 thus enable tangs 18 to make a positive electric ground connection even if the knock out holes may vary slightly in size from box to box or hole to hole.

From the foregoing, the described connector 10 can be readily inserted with a snap fit with a minimum of insertion force. At the same time, the tangs 18 and 20 of the locking or retainer ring 17 are shaped to provide for positive electric grounding of the connector with the associated electric box. The annular recess or space 15 provides a relief which allows the tangs 18 and 20 to be depressed into the underlying recess 15 to facilitate the insertion of the connector.

With the construction described, it will be further noted that the connector 10 in the assembled position with the electrical box 19 is firmly secured to the electrical box as the electrical box wall is tightly squeezed between the intermediate stop flange 12 and the retaining tangs 20, as noted in FIGS. 5 and 6, to virtually eliminate any play or movement between the connector 10 and its associated electrical box 19.

FIGS. 7 to 13 illustrate another embodiment. The embodiment of FIGS. 7 to 13 is directed to a connector assembly 39 that includes a body or sleeve 40 having an inlet end 40A and an outlet end 40B. An outwardly extending flange 41 circumscribes the inlet end 40A. The outlet end 40B is provided with external threads 42. In the illustrated embodiment, the threads 42 are interrupted, i.e. the outlet end 40B has spaced apart threaded portions 42A, 42B that extend about the circumference of the outlet 40B less than 180°. The opposed sides of the outlet end 40B that are free or devoid of any threads define a generally flat surface 43.

Figure 7:
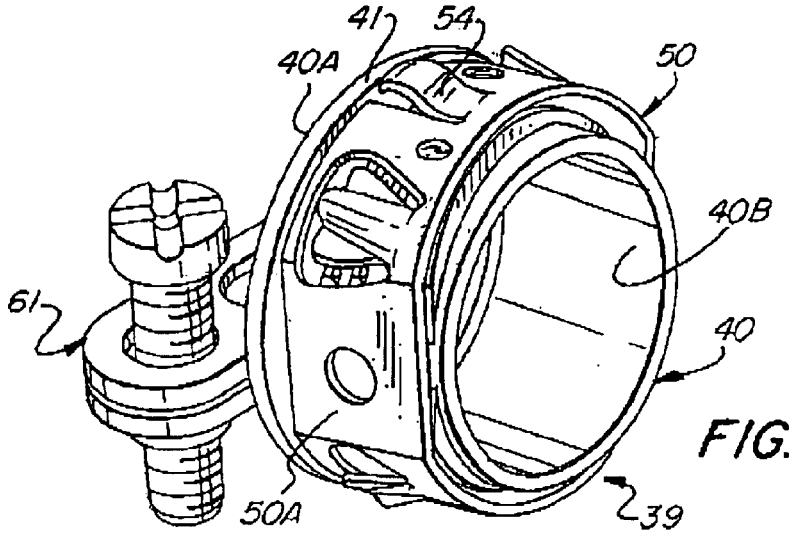
FIG. 7 is a perspective view of another embodiment of the invention.
Figure 8:
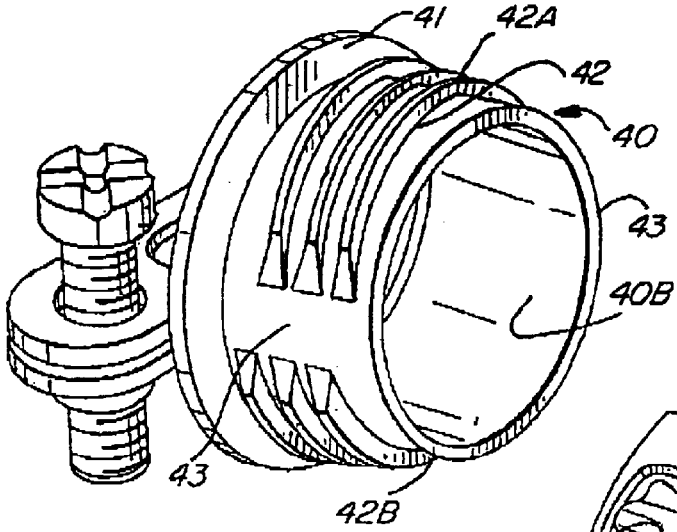
FIG. 8 is a perspective view of the connector body of FIG. 7.
Figure 9:
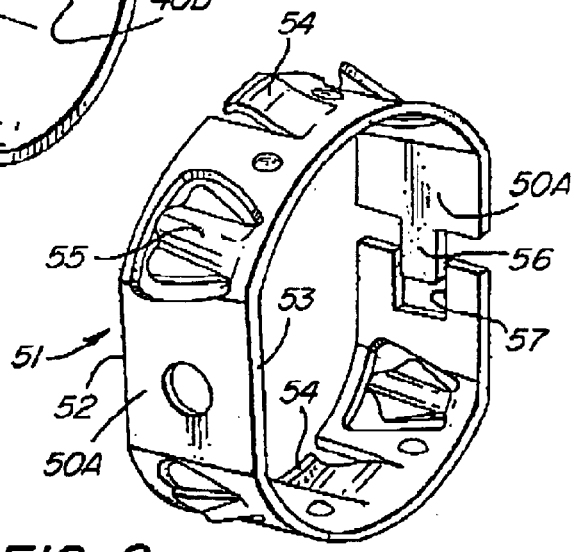
FIG. 9 is a perspective view of a modified embodiment of a snap fit retaining ring for use with a threaded connector of FIG. 8.
Figure 10:
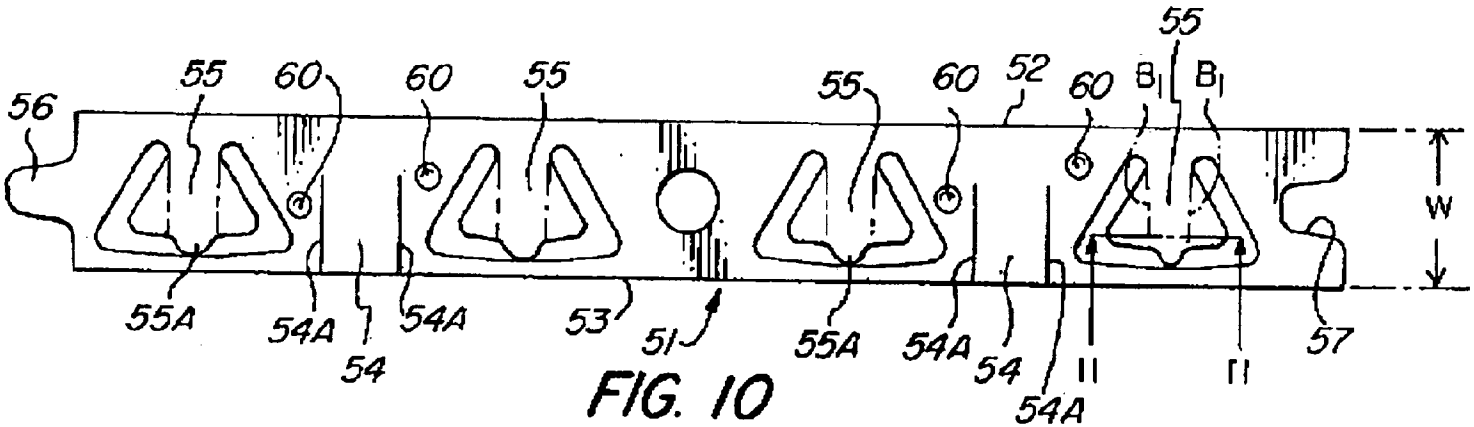
FIG. 10 is a detail top plan view of the blank from which the snap ring of FIG. 9 is formed.

Adapted to be disposed about the threaded portion of the outlet end41B is a modified snap fit retaining ring 50, as noted in FIGS. 7 and 9. The snap fit retaining ring 50 is formed from an elongated blank 51 of spring steel as shown in FIG. 10.

The blank 51 has a width W, substantially equal to the axial length of the threaded outlet end 40B. The blank 51 is provided with a leading longitudinal edge 52 and a trailing longitudinal edge 53. As shown in the embodiment of FIG. 10, the blank 51 has two forms of tangs, viz. tangs 54 and 55 that are formed from the material of the blank 51. Both forms of tangs 54 and 55 of FIG. 10 are blanked, lanced or die cut out of the material of the blank 51. Tangs 54 are defined or formed by cut lines 54A, 54A that extend inwardly or normal to the trailing edge 53. As hereinbefore described with respect to FIG. 1, tangs 54 are formed so that the free ends of the tangs 54 include a portion of the longitudinal edge 53 of the blank 51. As best noted in FIG. 7, tangs 54 may be formed or shaped in a manner as hereinbefore described.

Figure 11:
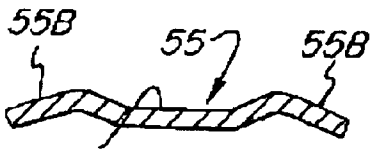
FIG. 11 is a section view taken along line 11—11 on FIG. 10.
Figure 13:
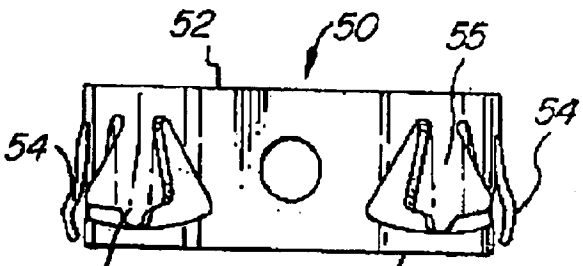
FIG. 13 is a top plan view of FIG. 12.
Figure 12:
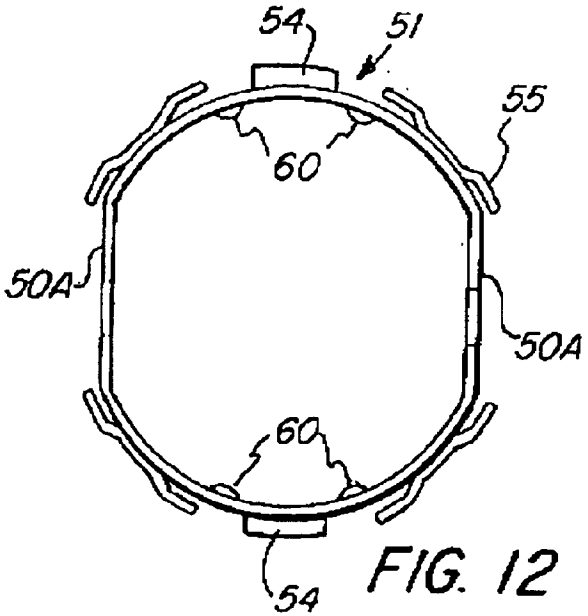
FIG. 12 is a front view of the snap ring formed from the blank of FIG. 10.

Tangs 55 are formed, blanked, lanced, or die cut out of the portion of the blank 51 disposed between the leading and trail edges 52, 53. Tangs 55 so formed are also bent outwardly from the plane or surface of blank 51. Thus, the free ends of tangs 55 are spaced inwardly from the trailing edge 53. As noted, tangs 55 are generally triangular in shape wherein the base of the triangular shaped tang 55 defines the free end. Intermediate the base or free end, the tangs 55 are provided with a tit or projection 55A. Referring to FIG. 11, tangs 55, when fully formed, have the opposed sides 55B, 55B thereof angularly offset outwardly from the central portion 55C of the tang 55 about bend lines $B_1$, $B_1$ to define a gull wing shape in cross section, as beat seen in FIG. 11.

One end of the blank is formed with a projecting tongue 56, and the opposite end is provided with a complementary notch 57 which is adapted to receive the tongue 56 when the blank 51 is formed to a ring as noted in FIG. 9. The blank 51, as described, when formed into a ring 50, has the opposed sides of the ring flattened as indicated at 50A, 50A, as best noted in FIG. 12, so that the ring 50 is rendered oval shaped and does not form a true circular ring. When the ring 50 is formed, the flattened portions 50A, 50A are arranged or fitted onto the connector body 40 so that the flattened portion 50A, 50A of the ring 51 complement the flattened or thread free portions 43 of the connector outlet end 42B. In the assembled position, the ring 50 being slightly oval shaped will prohibit any relative rotation between the ring 50 and the connector body 40.

In accordance with this invention, the blank 51 is also provided with a plurality of longitudinally spaced dimples or depressions 60 that are also laterally staggered transversely of the width W. The dimples or depressions 60 project radially inwardly of the ring 50 when formed, as noted in FIG. 12. The arrangement of the dimples or depressions 60 is such that when the retainer ring 50 is positioned onto the threaded outlet end of the connector body, the dimples or depressions 60 are received in the thread groove defined between adjacent threads. Thus, the dimples or depressions 60 mated in the grooves between adjacent threads function to deter any separation between the connector body and the retainer ring 50 when the connector is secured to an electric box. The arrangement is such that the retaining ring 50 can be readily removed.

In operation, the connector assembly 39, including the connector body 40 and the retaining ring 50, can be readily and expeditiously connected to an electric box simply by pushing the leading edge of the connector assembly 39 through a knock out opening of the electric box. In doing so, the tangs 54 and 55 are depressed, permitting the assembly 39 to be inserted through the knock out opening. As the connected assembly is seated, the tangs 54 spring outwardly to engage the side of the electric box to lock or secure the assembly 39 to the electric box and tangs 55 spring outwardly to also provide a positive electric grounding connection as hereinbefore described with respect to FIGS. 1 to 6. The depression or dimples 60 mating in the groove between adjacent threads of the connector 40 prohibits the connector body 40 from being pulled out or separated from the electric box.

Connected to and forming a part of the connector body is a clamping means 61 for fixedly securing a conductor, wire, cable or the like to the connector body.

Alternately, the connector assembly 39 may also be connected to an electric box by effecting the removal of the snap fit retainer ring 50 and utilizing the threads 42 to effect a screw type connection of the connector 39 to an electric box having a threaded female hub.

While the present invention has been described with respect to several embodiments, it will be understood that various modifications may be made without departing from the spirit or scope of the invention.

What is claimed is:

1. An electrical connector comprising:

a connector body having an inlet end and an outlet end, said outlet end including a pair of spaced apart shoulders and an outer surface disposed between said shoulders, said shoulders extending radially outwardly of said outlet end, an annular retainer ring supported directly on said shoulders and spaced from said outer surface of said outlet end disposed between said spaced apart shoulders to define a relief space between said annular retainer ring and said outer surface of said outlet end, a plurality of spring tangs blanked out of said retainer ring.

said tangs being circumferentially spaced about said retainer ring and projecting outwardly of said retainer ring in a cantilever manner, said tangs being spaced above said outer surface so that upon inserting said outlet end through a knock out hole, said tangs are free to deflect into said relief space to reduce the force required for insertion of said connector through a knock out hole of an electric box to effect a snap fit connection.

2. An electrical connector comprising:

a connector body having an inlet end and an outlet end, said outlet end having opposed arcuate portions and opposed flattened portions interconnecting said arcuate portions, external threads defining a groove between adjacent threads formed on said opposed arcuate portions of said outlet end, a snap fit retainer ring circumscribing said outlet end, said retainer ring having opposed curvilinear portions complementing said arcuate portions and opposed planer portions complementing said flattened portions of said outlet end, said retainer ring having a plurality of tangs formed out of said curvilinear portions of said retainer ring, said tangs being circumferentially spaced about said curvilinear portions of said retainer ring, and said tangs projecting radially outwardly of said retainer ring in a cantilever manner, and said retainer ring having a plurality of dimples forming depressions circumferentially spaced about the inner circumference of said curvilinear portions of said retainer ring and projecting inwardly of said retainer ring, said dimples being arranged to project into said groove defined between said adjacent threads for prohibiting separation of the connector body from said retainer ring when secured to an electric box, said complementary flattened portions of said outlet end and complementary planer portions of said retainer ring prohibit any rotation of said retainer ring relative to said outlet end, wherein said plurality of tangs include a series of tangs blanked out of the material of said retainer ring whereby each tan of said series has a free end which includes a longitudinal trailing edge portion of said retainer ring, and said longitudinal trailing edge portion being arcuately shaped so as to engage the edge of a knock out hole of an electric box for effecting electrical grounding of said connector, wherein said plurality of tangs includes a second series of tangs circumferentially spaced about said retainer ring, each of said second series of tangs being disposed about said retainer ring intermediately between the opposed longitudinal edges of said retainer ring, said tangs of said second series of tangs having a free end and opposed outer wing portions adapted to engage an inner surface of the electric box, and said free end of each of said second series of tangs having a projecting tit adapted to engage a peripheral portion of the knock out hole of an electrical box.

3. An electrical connector assembly in combination with an electric box having at least one knockout hole comprising:

a connector body defining an inlet end and an outlet end, said outlet end having opposed arcuate portions and flattened portions interconnected between said arcuate portions, an outwardly radially extending flange circumscribing said connector body, said flange forming a stop to limit the movement of said connector body through the knock out hole of the electrical box, external threads defining a groove between adjacent threads formed on said arcuate portions of said outlet end, said flattened portion of said outlet end being free of any threads, a snap fit retainer ring supported on said external threads, said snap fit retainer ring having opposed curvilinear portions and interconnecting opposed planer portions complementing said arcuate and flattened portions of said outlet end, said snap fit retainer ring including a plurality of circumferentially spaced tangs formed on said curvilinear portions, said plurality of tangs including a first series of spaced apart tangs, said tangs of said first series of tangs being blanked out of the material of said retainer ring, said tangs of said first series of tangs being bent laterally outwardly of said retainer ring whereby the free end of said first series of tangs includes a longitudinal trailing edge portion of said retainer ring, and said plurality of tangs including a second series of tangs, said tangs of said second series of tangs being blanked out of said retainer ring disposed wholly between the opposed longitudinal edges of said retainer ring, said tangs of said second series of tangs being bent laterally outwardly of said retainer ring, and said tangs of said second series of tangs including opposed outwardly bent wing portions and a projecting tit whereby the free ends of said wing portions are adapted to engage the inner surface of the electrical box and said projecting tit engages the inner periphery of the knock out hole to insure an electric grounding connection therebetween, said retainer ring having a plurality of dimples forming depression circumferentially spaced about the inner circumference of said retainer ring.

said dimples projecting inwardly of said retainer ring whereby said dimples engage said groove formed between adjacent threads, wherein said dimples are laterally spaced transversely of the width of said retainer ring, and a clamping means connected to said inlet end for securing a conductor relative to said connector body.

4. An electrical connector assembly as defined in claim 3 wherein said snap fit retainer ring is rendered readily removable from said external threads, whereby said outlet end may be optionally threadedly connected to an outlet box.

* * * * *